United States Patent [19]

Buchner et al.

[11] 4,091,930

[45] May 30, 1978

[54] CONTAINER

[75] Inventors: Norbert Buchner, Winnenden-Hofen; Werner Brose, Rommelshausen, both of Germany

[73] Assignee: Robert Bosch GmbH, Stuttgart, Germany

[21] Appl. No.: 768,815

[22] Filed: Feb. 15, 1977

[30] Foreign Application Priority Data

Feb. 18, 1976 Germany ..... 7604691[U]

[51] Int. Cl.[2] ..... B65D 5/54; B65D 17/04

[52] U.S. Cl. ..... 206/605; 206/469; 206/484; 206/633; 215/256; 220/276; 229/43

[58] Field of Search ..... 206/469, 484, 498, 532, 206/605, 633, 634; 229/43, 51 D, 51 ST, 51 TS; 215/256; 220/276

[56] References Cited

U.S. PATENT DOCUMENTS

| | | | |
|---|---|---|---|
| 2,103,389 | 12/1937 | Salfisberg | 206/498 |
| 2,161,093 | 6/1939 | Salifsberg | 206/498 |
| 2,791,324 | 5/1957 | Knoop et al. | 206/484 |
| 3,049,224 | 8/1962 | Fredette et al. | 206/532 |
| 3,335,939 | 8/1967 | Robinson, Jr. | 229/51 TS |
| 3,338,400 | 8/1967 | Edgworth et al. | 206/484 |
| 3,456,784 | 7/1969 | Sirago | 206/498 |
| 3,831,837 | 8/1974 | Finger et al. | 229/51 TS |
| 3,983,994 | 10/1976 | Wyslotsky | 206/219 |
| 3,997,677 | 12/1976 | Hirsch et al. | 206/484 |
| 4,014,433 | 3/1977 | Cerwin | 206/63.3 |

*Primary Examiner*—William Price
*Assistant Examiner*—Bruce H. Bernstein
*Attorney, Agent, or Firm*—Edwin E. Greigg

[57] ABSTRACT

A container made from a foil or laminate material and provided with a cover which is sealed to a flange of the container by the application of heat. In order to facilitate removal of the cover, all or all but one of the corners of the container have cuts or kerfs extending from the outer edge up to the welded bead. To open the container, the tab defined by each kerf is grasped and pulled upwardly so that the adjacent strip of cover and flange is removed by tearing along one straight side of the polygonal container. The procedure is repeated at successive sides until all or all but one of the edge strips have been removed.

6 Claims, 2 Drawing Figures

CONTAINER

BACKGROUND OF THE INVENTION

The invention relates to a container package having a dish-shaped container with an edgewise flange covered by a lid which is welded to the flange.

Known containers of this type are constructed to be opened by peeling the cover foil from the flange of the container, thereby breaking the seam. It is a requirement for the satisfactory opening of such packages that the container portion is sufficiently rigid and that the seal or welding seam is not overly resistant to fracture.

OBJECT AND SUMMARY OF THE INVENTION

It is an object of the present invention to provide a container with a cover which can be formed from relatively thin foils or foil sandwiches and which can be sealed by welding. The cover foil is fastened to the flange with a tight welded seam capable of withstanding the heat of sterilization.

It is a further object of the invention to provide a container of the type described above which is capable of being opened with relative ease.

These and other objects are attained according to the invention by providing a container with a sealed cover in which a plurality of corners of the cover foil and of the flange is provided with notches or kerfs, the direction of which is along the line defined by the relatively narrow zone between the welding seam and the inner edge of the flange.

The container is opened by grasping the tabs formed by the various kerfs and pulling the tabs in the direction of the kerf thereby tearing off the portion of the cover and the flange along one edge. It has been shown that the fracture follows the zone lying between the inner edge of the flange and the welding seam without departing therefrom because, in its development, the fracture is guided by the thickened part of the welded seam and by the inner edge of the flange.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
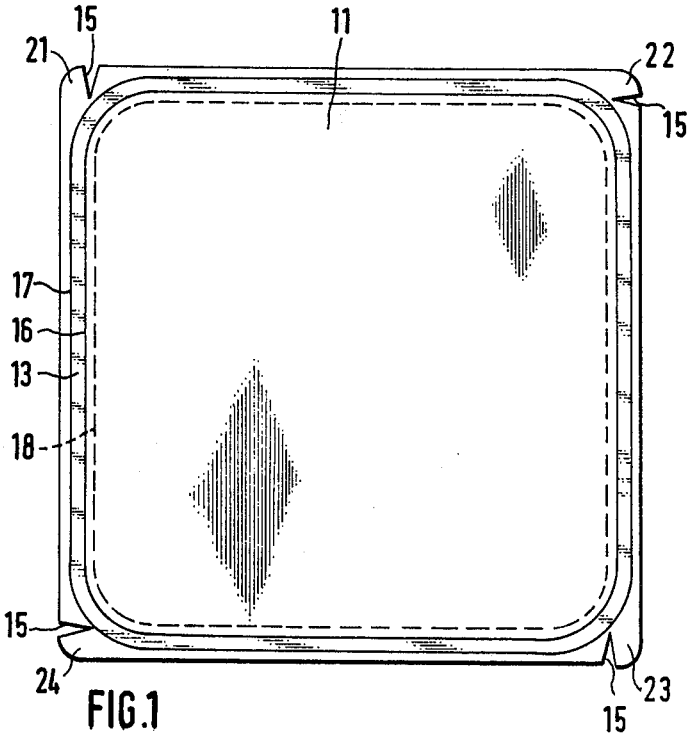
FIG. 1 is a top view of a square container package according to the invention.
Figure 2:
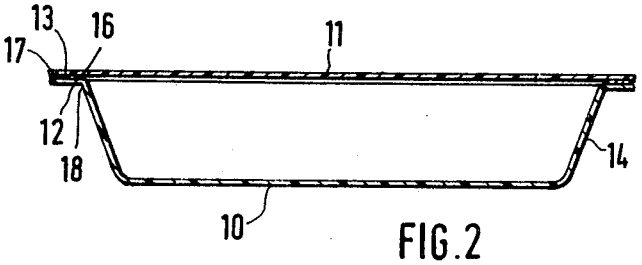
FIG. 2 is a cross section through the container illustrated in FIG. 1.

Turning to FIG. 1, there will be seen a top view of a container 10 and a cover foil 11 sealingly attached thereto. The container 10 and the cover foil 11 are made from a sterilizable metal/plastic laminate, the inside of which can be sealed by welding. Preferably, the laminate has an interior layer of aluminum foil of small thickness and outer layers of polypropylene.

The container 10 is dish-shaped and is provided with a surrounding narrow flange 12 at its open end. The cover foil 11 is welded to the top of the flange 12 by a frame-like welding seam 13. The lateral extent of the welding seam 13 is less than the width of the flange 12.

The overall configuration of the flange 12 and of the cover foil 11 in the preferred embodiment is a square with straight sides. The wall portions 14 of the container 10 are adapted to correspond to the overall shape, although the corners may be rounded. Accordingly, the corners of the welding seam 13 are also rounded. To make provision for opening the package for the purpose of removing its content, each of the corner regions of the cover foil 11 and of the underlying flange 12 is shown to be provided with a kerf 15. These kerfs are so disposed as to point along an edge of the package and to describe the same rotational direction with respect to the center of the package. In particular, each of the kerfs 15 points along one of the four straight-line narrow zones defined between the interior periphery 16 of the welding seam 13 and the interior edge 18 of the flange 12. The points of each kerf 15 extend almost to the exterior periphery 17 of the welding seam 13.

The kerfs 15 define four tabs 21–24 which may be grasped with the thumb and index finger. When the package is to be opened, the tabs are grasped and the edge regions of the cover foil 11, as well as of the flange, are removed by tearing. For this purpose, the tabs 21–24 are grasped one after the other and are pulled in the direction indicated by the corresponding kerf 15. In that process, the edge strip extending from the corner containing the kerf and the corner generally aimed at by the kerf being used is pulled from the package and the fracture is confined to the zone between the interior periphery 16 of the welded seam 13 and the base or inner edge 18 of the flange 12. All four of the edge strips can be removed separately and the remainder of the cover foil 11 pulled from this package. Alternatively, it is possible to remove only three edge strips and to flip open the cover foil, possibly to reclose the package therewith after the removal of its content.

The depth of each kerf is so chosen as to be roughly equal to the width of a flange in a straight line portion of the package. The purpose of choosing the depth of the kerf in this manner is to leave a succeeding tab in place when the edge strip of the preceding side is being pulled off. The corners of the package and of the welded seam are sufficiently rounded so as to permit the kerf to attain this depth without injuring the seam 13.

When the edge strip is pulled off upwardly, the fracture is confined to the region between the thickened inner periphery of the welded seam 13 and the downwardly directed wall 14 of the body of the container. This confinement of guidance of the fracture can be further improved by providing a crimp in the foil 11 and the flange 12 adjacent to the welded seam. The downwardly extending side of the crimp further guides the fracture which is proceeding upwardly.

If it is intended merely to flip open the foil 11 without removing it completely, a square container requires only three kerfs. The edge portion which cannot be removed by tearing provides the hinge for the reclosable foil.

In the exemplary embodiment illustrated, the tearoff tabs 21–24 are defined by wedge-shaped kerfs 15. The kerfs 15 can also be merely cuts. The kerfs or cuts could be extended into the welded seam, thereby severing the outer periphery of the welded seam and facilitating the initiation of the tear. If this latter embodiment is chosen, the welded seam may be suitably reinforced in the vicinity of the kerfs by lateral enlargement.

The foregoing relates to a preferred exemplary embodiment of the invention it being understood that other varients and embodiments thereof are possible within the spirit and scope of the invention, the latter being defined by the appended claims.

What is claimed is:

1. In a container which includes a dish having a base and an upstanding wall and which defines an open-ended interior volume, said wall defining an outstanding flange around the periphery of the open end of said dish, and a cover for closing the open end of said dish, said cover being sealable to said flange by the application of heat to form a continuous welded bead on an intermediate area of said flange when sealed, the improvement comprising:

said dish and said cover have a periphery in the shape of a polygon and on at least each but one corner of said polygon, there is provided in said flange and said cover a kerf making an incision in said flange and said cover and extending from the periphery of said flange and said cover along one side of the corner to a point substantially adjacent to said bead, said kerf pointing in the direction of a zone lying between and jointly defined by the inner edge of said flange and said welded bead; whereby, when said corner is pulled away from said dish, said flange together with the overlying portion of said cover are separated from said dish along said zone.

2. A container as defined by claim 1 wherein said kerfs are so located that an arrow so placed as to point from the open end to the closed end of each kerf defines the same sense of rotation with respect to the center of said container for all of said kerfs.

3. A container as defined by claim 2, wherein the corner portions of said welded bead are rounded.

4. A container as defined by claim 1, wherein said kerfs extend into a portion of said welded bead.

5. A container as defined by claim 1 wherein said kerf is a single cut incising said cover and said flange.

6. A container as defined by claim 1, wherein said dish and said cover are made from a metal-plastic laminate material.

* * * * *